US007780476B2

(12) United States Patent
Sun et al.

(10) Patent No.: US 7,780,476 B2
(45) Date of Patent: Aug. 24, 2010

(54) ELECTRICAL CARD CONNECTOR

(75) Inventors: Yun-Song Sun, Kunshan (CN); Qi-Jun Zhao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 72 days.

(21) Appl. No.: 12/082,555

(22) Filed: Apr. 11, 2008

(65) Prior Publication Data

US 2008/0254657 A1 Oct. 16, 2008

(30) Foreign Application Priority Data

Apr. 11, 2007 (CN) ..... 2007 2 0035994

(51) Int. Cl.
*H01R 24/00* (2006.01)

(52) U.S. Cl. ..... 439/630; 439/159

(58) Field of Classification Search ..... 439/159, 439/630–635

See application file for complete search history.

(56) References Cited

U.S. PATENT DOCUMENTS 6,358,089 B1 * 3/2002 Kuroda et al. ..... 439/607.13
6,508,402 B1 1/2003 Takada et al.
6,520,784 B2 2/2003 Ito et al.
6,572,392 B2 6/2003 Motojima
6,692,276 B1 2/2004 Abe et al.
6,692,277 B2 2/2004 Hu et al.
6,896,532 B2 5/2005 Chang
2005/0233645 A1 * 10/2005 Michel et al. ..... 439/630
2006/0134954 A1 * 6/2006 Xu et al. ..... 439/159
2007/0134959 A1 * 6/2007 Hsiao ..... 439/159

* cited by examiner

*Primary Examiner*—Ross N Gushi
(74) *Attorney, Agent, or Firm*—Wei Te Chung; Andrew C. Cheng; Ming Chieh Chang

(57) ABSTRACT

An electrical card connector (100) includes an insulative housing (1) and a plurality of signal contacts (3) retained in the insulative housing. The insulative housing has a pair of side walls (14), a connecting plate (17) extending laterally to connect the side walls, and a pair of supporting rails (172) being adjacent to the side walls and extending upwardly from the connecting plate. A receiving slot (13) is formed between the side walls and the supporting rails to receive an electrical card. The signal contacts (3) extend into the receiving slot.

16 Claims, 7 Drawing Sheets

ELECTRICAL CARD CONNECTOR

BACKGROUND OF THE INVENTION

1. Field of the Invention

The present invention generally relates to an electrical card connector and more particularly to an electrical card connector having improved housing.

2. Description of Related Art

A conventional electrical card connector is usually used in electrical equipments such as digital camera, mobile phone and the like for contacting with an electrical card. The electrical card connector is mounted on a printed circuit board, and comprises an insulative housing defining a front mating face, a receiving cavity extending through the front mating face and a plurality of contacts retained in the receiving cavity. The receiving cavity is formed between a pair of side walls and a bottom wall of the insulative housing. In use, the card is inserted into the receiving cavity along a front-to-rear direction, resulting in a friction engagement between a bottom face of the card and an upper face of the bottom wall of the insulative housing. In this manner, the insertion or the retraction of the card is not convenient since contacting surfaces between the card and the housing is large.

It is thus desired to provide an electrical connector having an improved soldering portion.

SUMMARY OF THE INVENTION

According to the present invention, an electrical card connector includes an insulative housing and a plurality of signal contacts retained in the insulative housing. The insulative housing has a pair of side walls, a connecting plate extending laterally to connect the side walls, and a pair of supporting rails being adjacent to the side walls and extending upwardly from the connecting plate. A receiving slot is formed between the side walls and the supporting rails to receive an electrical card. The signal contacts extend into the receiving slot.

Other objects, advantages and novel features of the present invention will become more apparent from the following detailed description of the present embodiment when taken in conjunction with the accompanying drawings.

DETAILED DESCRIPTION OF THE INVENTION

Figure 1:
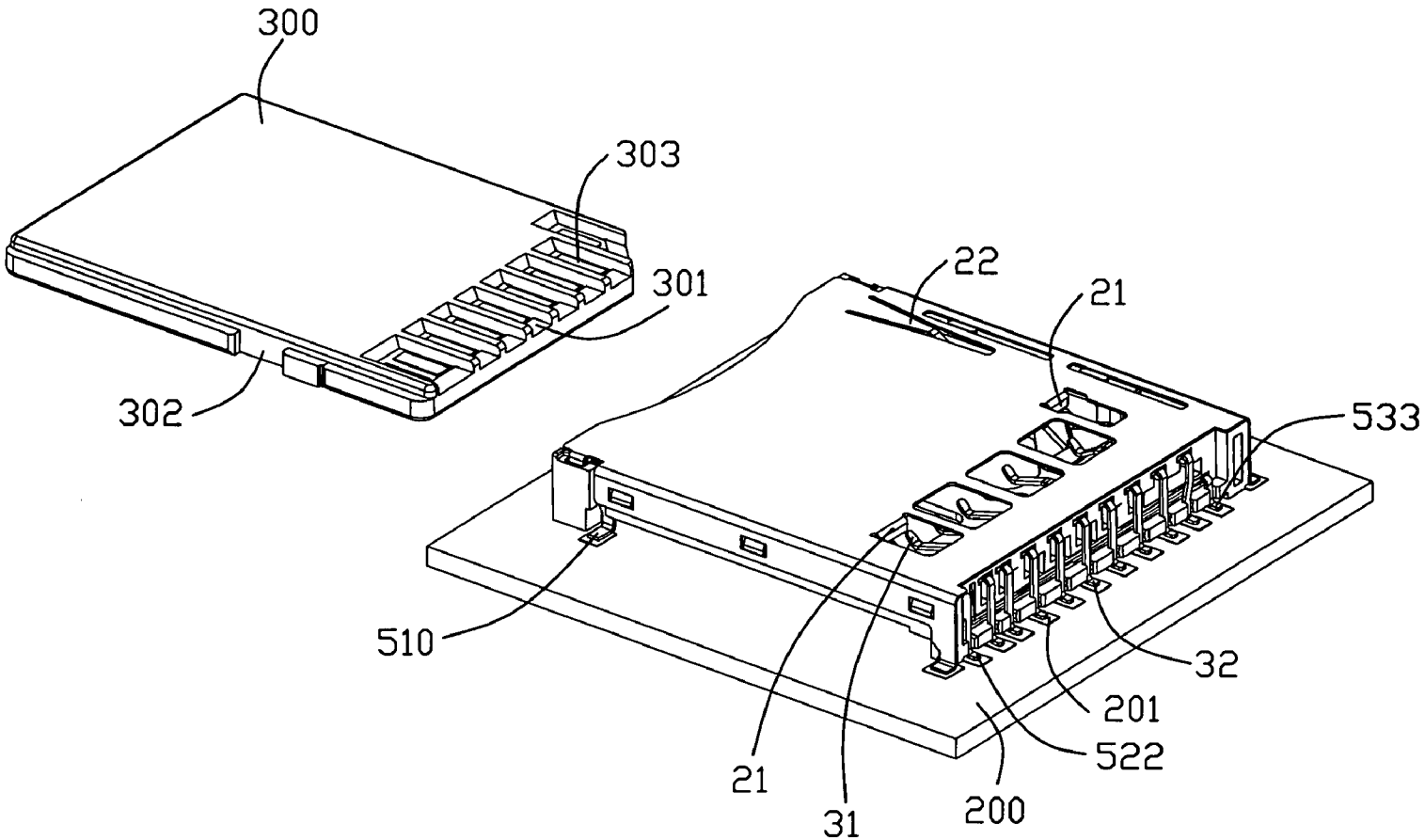
FIG. 1 is a partially assembled view of an electrical connector, an electrical card and a printed circuit board according to the present invention.

Reference will now be made to the drawing figures to describe the preferred embodiment of the present invention in detail.

Figure 2:
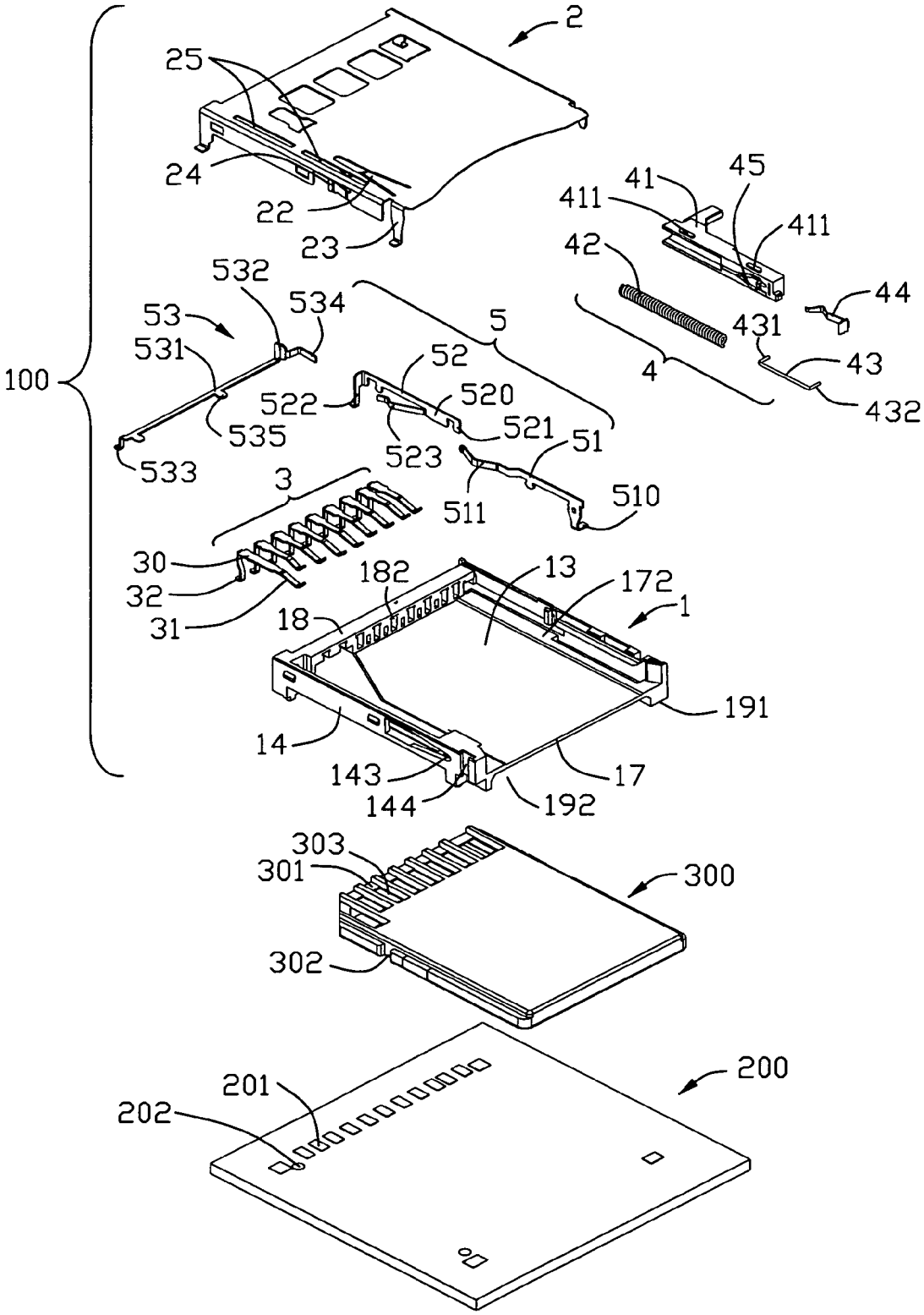
FIG. 2 is an exploded perspective view of the electrical connector, the electrical card and the printed circuit board.
Figure 3:
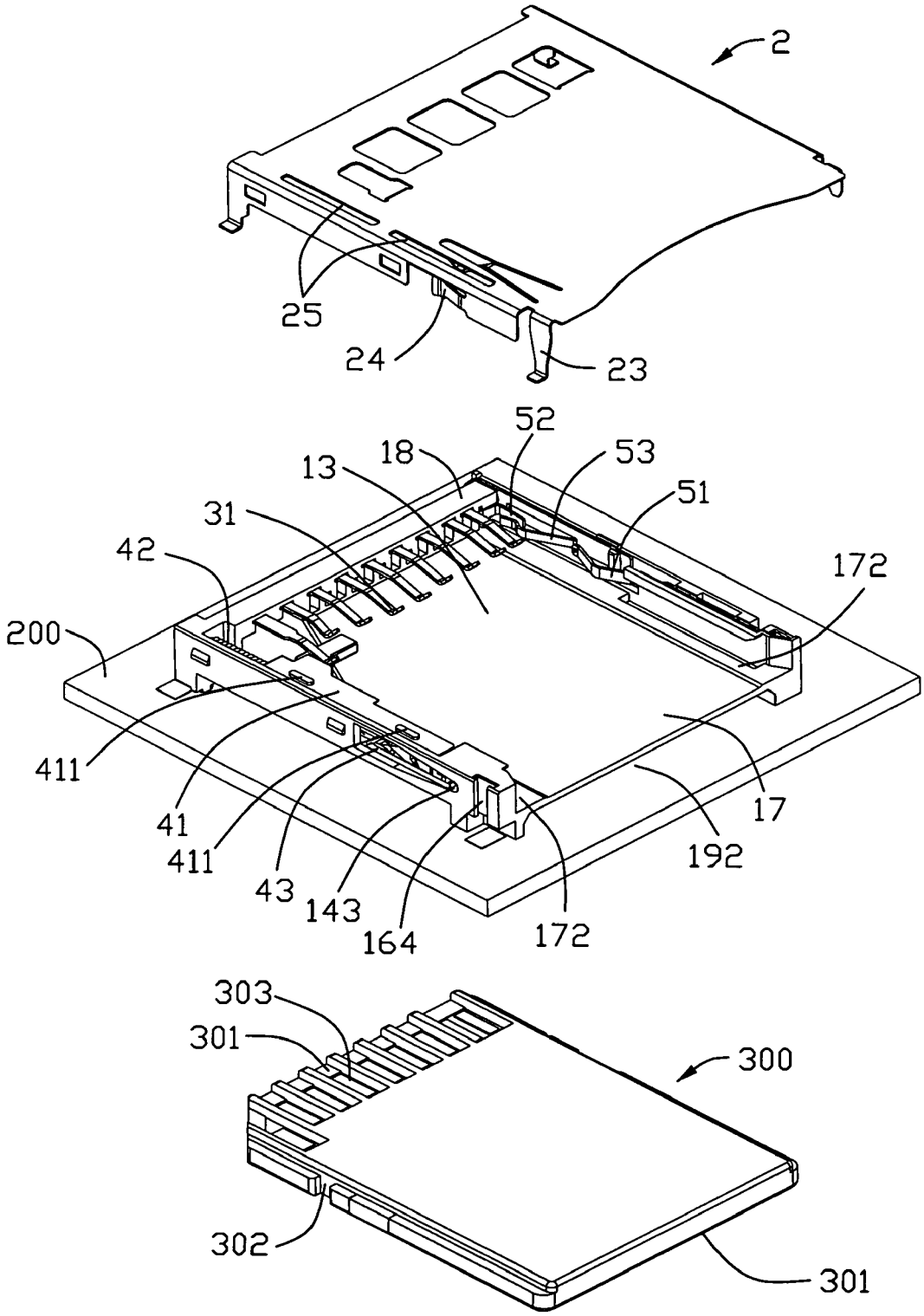
FIG. 3 is a partially exploded view of the electrical connector, the electrical card and the printed circuit board.
Figure 4:
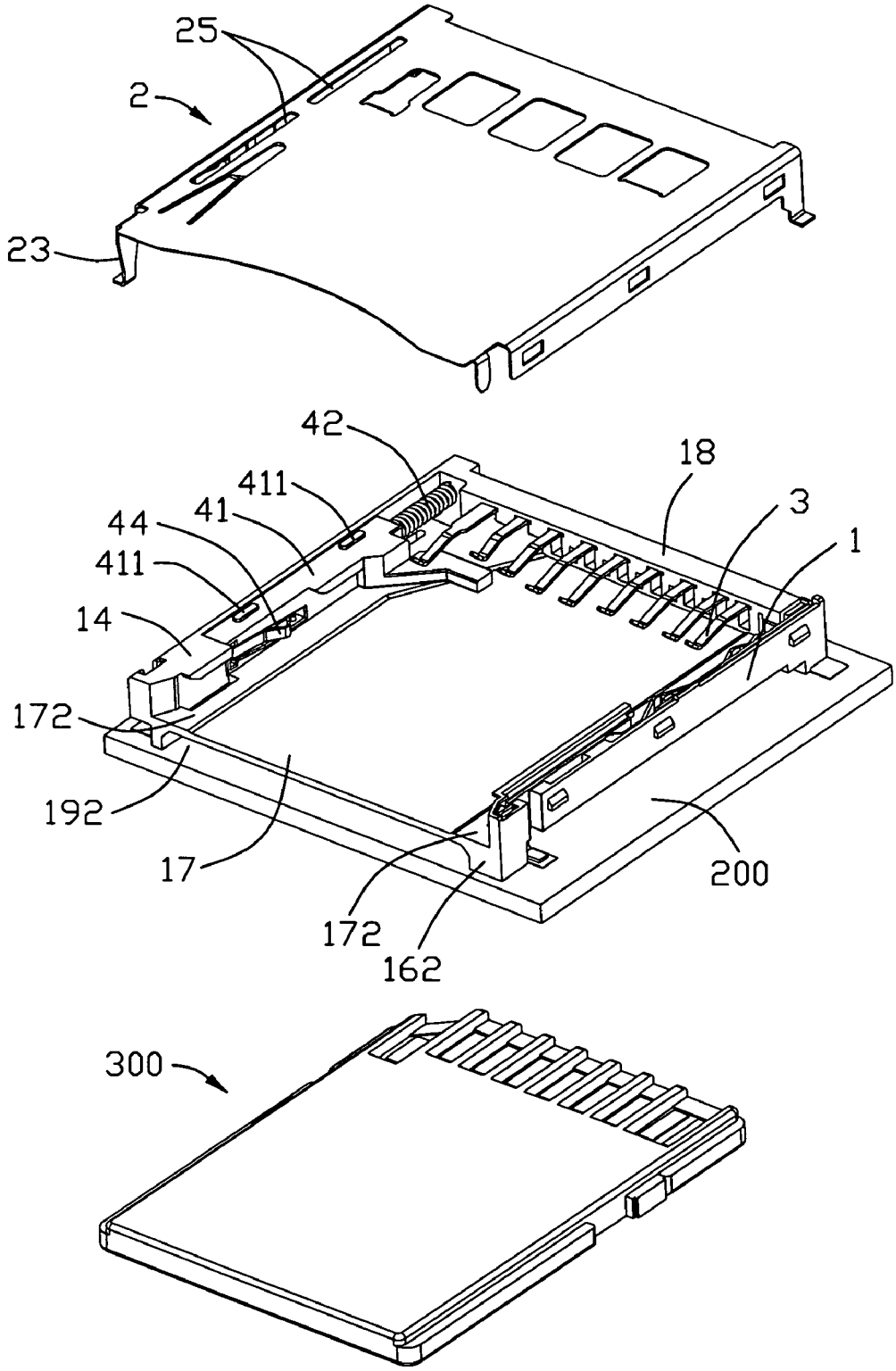
FIG. 4 is a view similar to FIG. 3, while taken from a different aspect.
Figure 5:
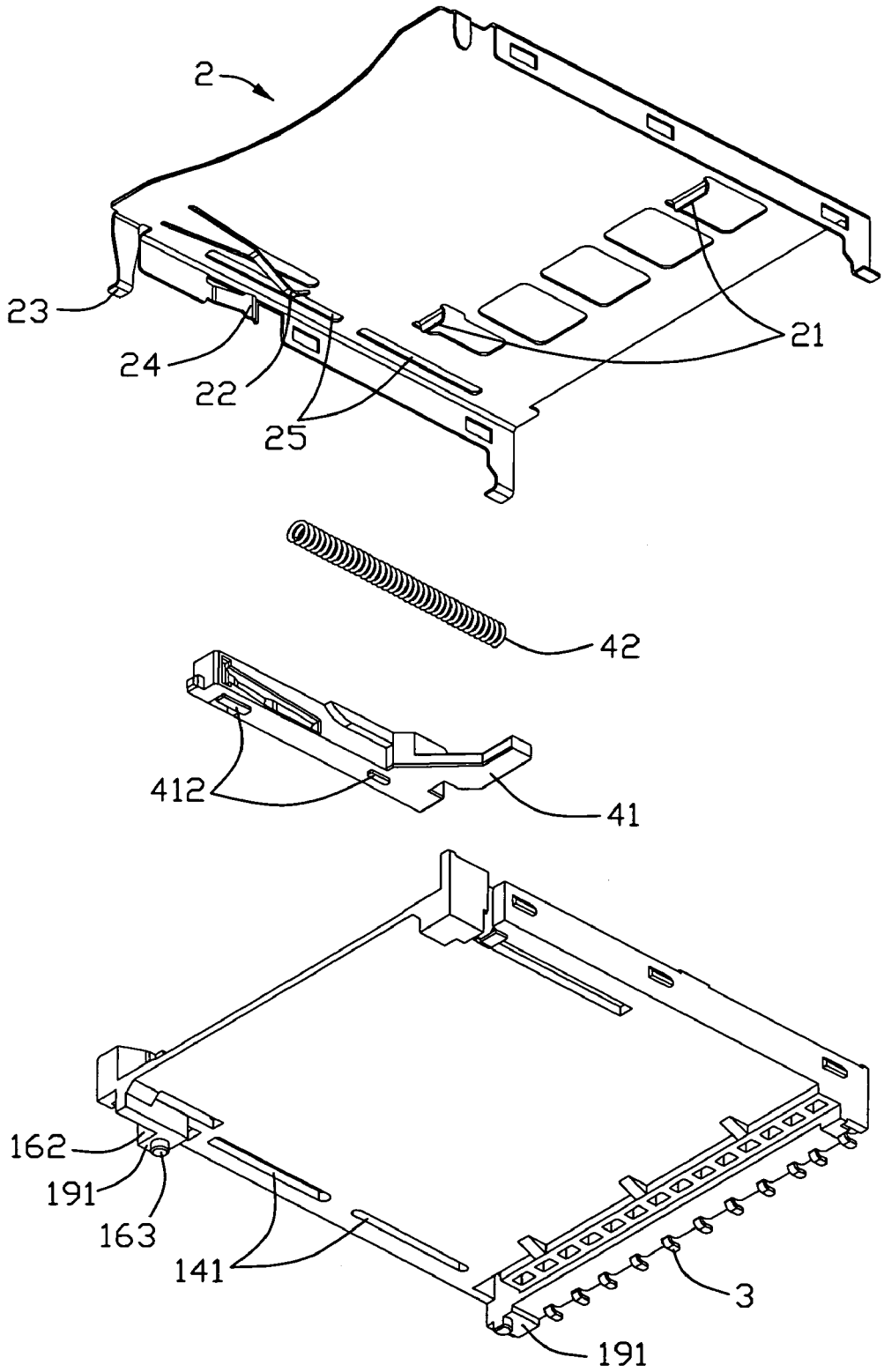
FIG. 5 is a partially exploded view of the electrical connector.
Figure 6:
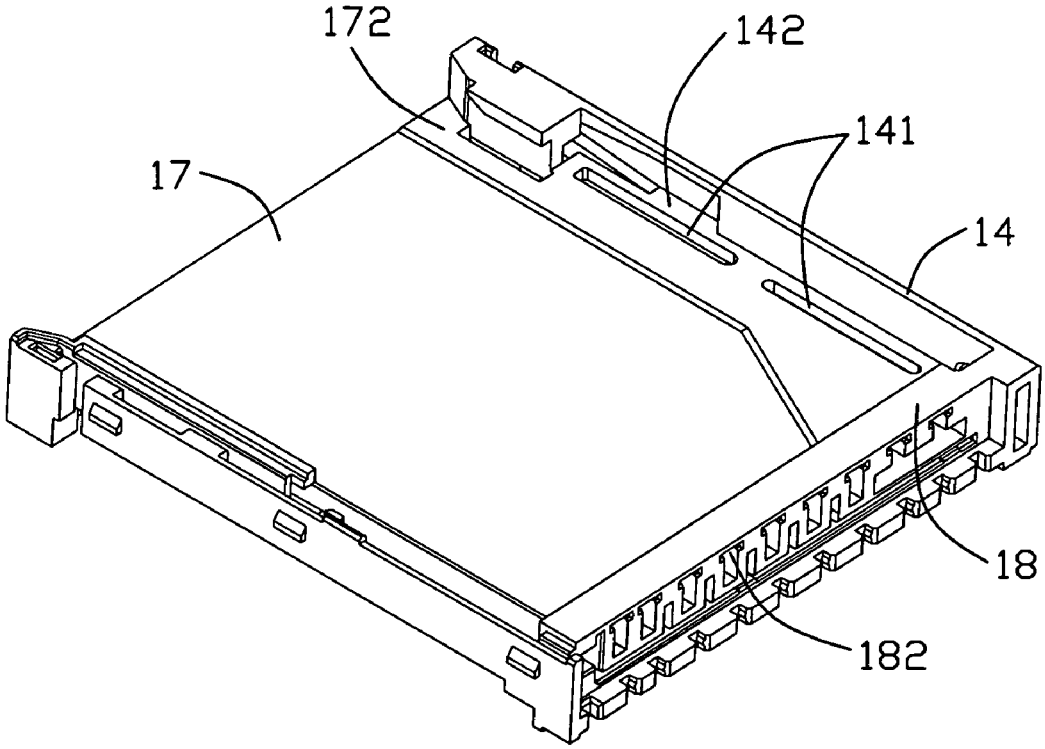
FIG. 6 is a perspective view of an insulative housing of the electrical card connector.
Figure 7:
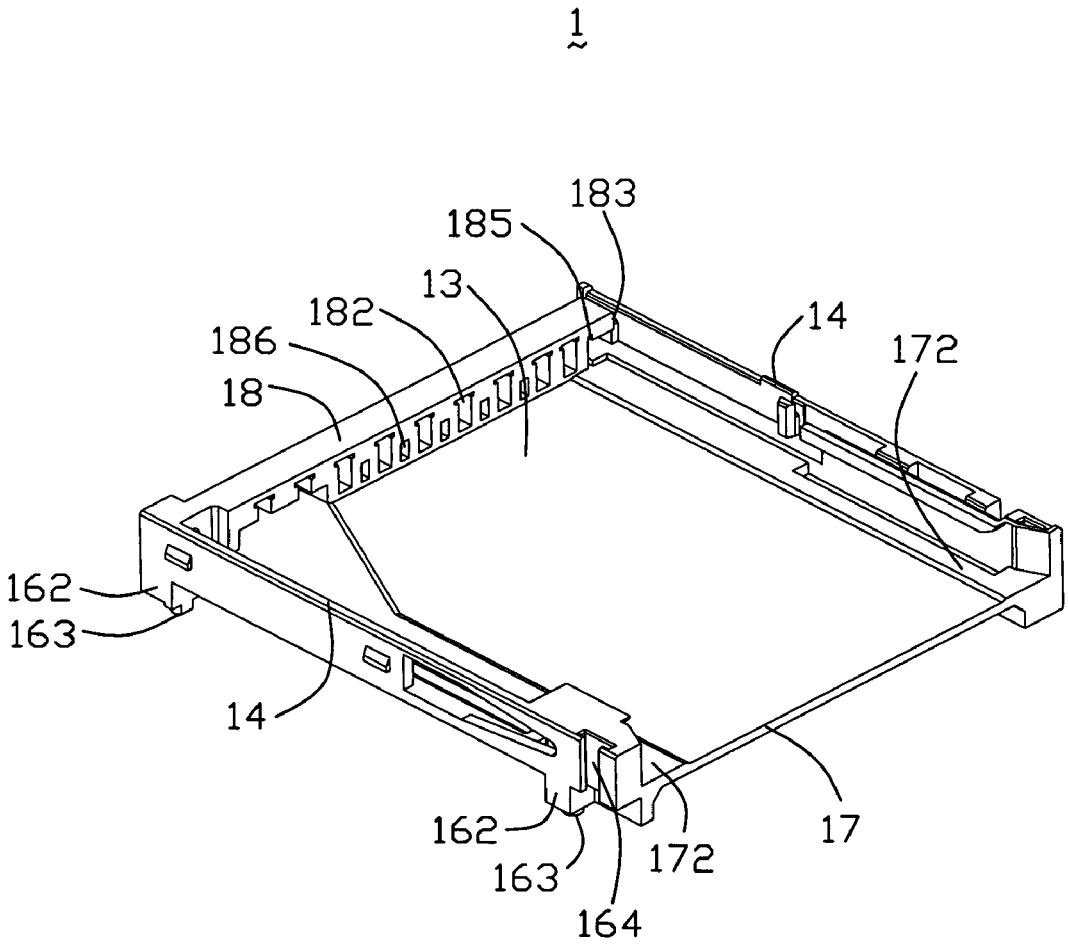
FIG. 7 is a view similar to FIG. 6, while taken from a different aspect.

Referring to FIGS. 1 and 2, an electrical card connector 100 mounted on a printed circuit board 200 to receive an electrical card 300, comprises an insulative housing 1, a plurality of signal contacts 3, a switch 5 fixed in the housing 1, an ejecting mechanism 4, and a metal shell 2 enclosing the housing 1.

The housing 1 includes a pair of side walls 14, a connecting plate 17 extending laterally and connecting the side walls 14, a rear wall 18 connecting both the side walls 14 and the connecting plate 17. The connecting plate 17 is formed with a pair of supporting rails 172 extending upwardly in a lengthwise direction of the housing 1 for supporting a bottom surface of the electrical card 300. A receiving slot 13 is formed between the side walls 14 and the supporting rails 172, that is to say, the bottom face of the electrical card 300 does not contact with the connecting plate 17 except for the supporting rails 172, thereby decreasing friction between the bottom face of the electrical card 300 and the connecting plate 17 and facilitating insertion/ejection of the electrical card 300.

A plurality of standoffs 162 extend downwardly from a bottom face of the connecting plate 17. The housing 1 has a board mounting surface 191 which is defined by a bottom face of the standoffs 162. The connecting plate 17 is spaced apart from the board mounting surface 191. An opening 192 is formed between the connecting plate 17 and the board mounting surface 191 to receive electronic components on the printed circuit board 200. The standoff 162 is provided with a post 163 which is adapted to be mounted in a corresponding hole 202 on the printed circuit board 200.

The signal contacts 3 each have a retaining portion 30 fixed in the housing 1, a contacting arm 31 projecting forwardly from the retaining portion 30 for contacting with contact pads 303 on the electrical card 300, and a soldering portion 32 extending downwardly and rearwardly from the retaining portion 30 to be mounted on solder pads 201 on the printed circuit board 200. The rear wall 18 is provided with a plurality of retaining holes 182 for fixing the retaining portion 30. In use, the electrical card 300 with the contact pads 303 being located on an upper portion thereof is inserted into the receiving slot 13 and sandwiched by the supporting rails 172 and the contacting arms 31 in a vertical direction of the housing 1.

The switch 5 includes a first switch terminal 51, a second switch terminal 52 which extend along the side wall 14, and a third switch terminal 53 which extends substantially along the rear wall 18. The first switch terminal 51 has a first flexible arm 511 which is deflectable in a width direction of the housing 1 and a first solder portion 510 soldered onto the printed circuit board 200. The second switch terminal 52 includes a second base portion 520, a second flexible arm 523 which is deflectable in the width direction of the housing 1, a second solder portion 522 soldered onto the printed circuit board 200, and a second barb 521 fixed in the side wall 14. The third switch terminal 53 comprises a lateral arm 531, an upward portion 532 retained in a first rear slot 185 on the rear wall 18, a third contacting arm 534 extending forwardly from the upward portion 532, a third barb 535 secured in a fixing hole 186 on the rear wall 18, and a third solder portion 533 soldered onto the printed circuit board 200. In the process of insertion of the electrical card 300 into the receiving slot 13, the right side edge of the card 300 makes the first flexible arm 511 moves outwardly to contact with the second base portion 520 retained in a second rear slot 183 on the rear wall 18, and then deflects the second flexible arm 523 outwardly to establish electrical connection between the second flexible arm 523 and the third contacting arm 534, therefore the switch 5 is closed to allow for data transmission.

The ejecting mechanism 4 includes a slider 41 movably mounted in a recess 142 provided along the side wall 14 of the housing 1 and covered by the metal shell 2, a coil spring 42 for pushing the slider 41 to return to an initial position, and a pin member 43. A locking tab 44 is fixed on an inner side surface of the slider 41 to lock with cutout 302 on a side face of the electrical card 300. A cam groove 45 is provided on an outer side surface of the slider 41. One end 431 of the pin member 43 is movably mounted within the cam groove 45 to define the sliding operation of the slider 41. The other end 432 of pin member 43 is rotatably mounted within a position hole 143 formed on a front end of the side wall 14. The slider 41 is engageable with the electrical card 300 for movement between a forward position whereat the contact pads 303 are not in contact with the signal contacts 3 and a back position whereat the contact pads 303 are in contact with the signal contacts 3.

The shell 2 is provided with a spring finger portion 24 integral with the shell 2 for biasing the pin member 43 into the cam groove 45, a flexible tab 22 extending into the receiving slot 13 to abut against a top surface of the electrical card 300. A abutting tab 21 projects vertically from the top surface of the shell 2 and is located before a front end of the contacting arms 31. The abutting tab 21 corresponds to an upper slot 301 for receiving the contact pads 303, thereby ensuring that only the electrical card 300 having the upper slots 301 can be inserted into the receiving slot 13 to the full extent. The abutting tab 21 is adapted to abut a front end of an undesirable card to protect the signal contacts 3 from being destroyed by the undesirable card. A plurality of solder legs 23 projects downwardly from a front end of the shell 2 to be retained in a slit 144 provided on a side face of the side walls 14.

The slider 41 defines a first pair of guiding protrusions 411 extending from an upper face thereof and a second pair of guiding protrusions 412 extending from a lower face thereof. The first pair of guiding protrusions 411 are spaced apart from each other and aligned with each other along a front-to-rear direction, similarly, the second pair of guiding protrusions 412 are spaced apart from each other and aligned with each other along the front-to-rear direction. The side wall 14 defines a pair of first guiding slots 141 for receiving the second pair of guiding protrusions 412. The shell 2 includes a second pair of guiding slots 25 for receiving the first pair of guiding protrusions 411. The first pair of guiding protrusions 411 and the second pair of guiding protrusions 412 cooperate with the first guiding slots 141 and the second guiding slots 25 to make the slider 4 move along the side wall 14 smoothly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector, comprising:

an insulative housing having a pair of side walls, a connecting plate extending laterally to connect the side walls, a receiving slot formed between the side walls to receive an electrical card; and a plurality of signal contacts retained in the insulative housing and extending into the receiving slot;

a metal shell attached to the insulative housing;

an ejecting mechanism including a slider positioned between the insulative housing and the metal shell to engage with the electrical card, a spring for pushing the slider along a card ejection direction, and a pin having a first end fixed in the housing and a second end movably mounted on the slider;

the slider defines a first guiding protrusion extending from an upper face thereof and a second guiding protrusion extending from a lower face thereof, the side wall defines a first guiding slot to restrict the second guiding protrusion, and the shell includes a second guiding slot to restrict the first guiding protrusion.

2. The electrical card connector as claimed in claim 1, wherein the metal shell comprises an abutting tab projecting vertically from a top face thereof into the receiving slot to abut against an undesirable card.

3. The electrical card connector as claimed in claim 1, wherein the insulative housing includes a plurality of standoffs extending downwardly from the connecting plate and defining a board mounting surface, an opening is formed between the connecting plate and the board mounting surface.

4. The electrical card connector as claimed in claim 3, wherein the standoffs each includes a post extending downwardly from the board mounting surface to fix the insulative housing to a printed circuit board.

5. The electrical card connector as claimed in claim 1, further comprising a switch including a first switch terminal having a first flexible arm, a second switch terminal having a second flexible arm and a third switch terminal having a contacting arm, the first flexible arm coming to contact with the second flexible arm and the second flexible arm coming to contact with the contacting arm orderly upon card insertion.

6. The electrical card connector as claimed in claim 5, wherein the first switch terminal and the second switch terminal extending substantially along the side wall, and the third switch terminal extends in a direction substantially perpendicular to the side wall.

7. The electrical card connector as claimed in claim 1, wherein the housing includes a rear wall defining a plurality of retaining holes on an upper portion thereof, and wherein the signal contacts each include a retaining portion fixed in the retaining hole, a soldering portion extending downwardly from one end of the retaining portion and a spring arm extending forwardly and downwardly from the other end of the retaining portion, the spring arm and the housing are adapted to contact with opposite sides of the electrical card in a height direction of the insulative housing.

8. An electrical card connector, comprising:

an insulative housing having a receiving slot to receive an electrical card;

a plurality of contacts retained in the insulative housing and extending into the receiving slot; and a metal shell attached to the insulative housing, the metal shell comprises an abutting tab projecting downwardly from a top face thereof into the receiving slot to abut against an incorrect card for preventing mis-mating;

further comprising an ejecting mechanism including a slider to engage with the electrical card, a spring for pushing the slider along a card ejection direction, and a pin having a first end fixed in the housing and a second end movably mounted on the slider.

9. The electrical card connector as claimed in claim 8, wherein the insulative housing having a pair of side walls, a connecting plate extending laterally to connect the side walls, the housing including a plurality of standoffs extending downwardly from the connecting plate and defining a board mounting surface, the standoffs each includes a post extending downwardly from the board mounting surface to fix the insulative housing to a printed circuit board.

10. The electrical card connector as claimed in claim 8, wherein the slider defines a pair of first guiding protrusions extending from an upper face thereof and a pair of second guiding protrusions extending from a lower face thereof, the first guiding protrusions are spaced from each other and aligned with each other along a lengthwise direction of the insulative housing, the second guiding protrusions are spaced from each other and aligned with each other along the lengthwise direction of the insulative housing, the insulative housing defines a pair of first guiding slots to receive the second guiding protrusions, and the shell includes a pair of second guiding slots to receive the first guiding protrusions.

11. The electrical card connector as claimed in claim 8, wherein the housing includes a rear wall defining a plurality of retaining holes on an upper portion thereof, and wherein the signal contacts each include a retaining portion fixed in the retaining hole, a soldering portion extending downwardly from one end of the retaining portion and a spring arm extending forwardly and downwardly from the other end of the retaining portion, the spring arm and the housing are adapted to contact with opposite sides of the electrical card in a height direction of the insulative housing.

12. The electrical card connector as claimed in claim 8, wherein said abutting tab is positioned and sized to be received in a corresponding upper slot formed in the predetermined card under condition that said upper slot is equipped with a contact pad therein.

13. The electrical card connector as claimed in claim 12, wherein said abutting tab is located essentially adjacent to and in alignment with, along a front-to-back direction, one of the contacts under condition that said one of the contacts is adapted to be coupled to said contact pad.

14. A card connector assembly comprising:

an insulative housing defining two opposite side walls;

a metallic shell attached to and covering the housing and further cooperating with said housing to define a card receiving space;

a card received in the card receiving space, the card including a plurality of slots spaced from each other and a plurality of contact pads disposed in the slots, respectively; and a plurality of contacts disposed in the housing with contacting sections exposed in the card receiving space and mechanically and electrically connected to the corresponding contact pads, respectively; wherein said metallic shell comprises an abutting tab extending into the card receiving space and further into the corresponding one of the said slots of the card to assure only said card, which is equipped with said slots, can be correctly received in said card receiving slot.

15. The card connector assembly as claimed in claim 14, wherein said abutting tab is located adjacent to and in alignment with, along a front-to-back direction, the contact which is coupled to the contact pad located in said corresponding one of the slot into which said abutting tab is received.

16. The card connector assembly as claimed in claim 14, wherein said abutting tab downwardly extends from a top plate of the shell.

* * * * *